US011300138B2

(12) United States Patent
Au et al.

(10) Patent No.: US 11,300,138 B2
(45) Date of Patent: Apr. 12, 2022

(54) APPARATUS AND RELATED METHOD TO VARY FAN PERFORMANCE BY WAY OF MODULAR INTERCHANGEABLE PARTS

(71) Applicant: Meggitt Defense Systems, Inc., Irvine, CA (US)

(72) Inventors: Hilaryl Au, Irvine, CA (US); Sergey Samarchyants, Irvine, CA (US); Akshay Rathore, Irvine, CA (US)

(73) Assignee: Meggitt Defense Systems, Inc., Irvine, CA (US)

( * ) Notice: Subject to any disclaimer, the term of this patent is extended or adjusted under 35 U.S.C. 154(b) by 101 days.

(21) Appl. No.: 16/413,397

(22) Filed: May 15, 2019

(65) Prior Publication Data

US 2019/0360499 A1 Nov. 28, 2019

Related U.S. Application Data

(60) Provisional application No. 62/676,182, filed on May 24, 2018.

(51) Int. Cl.

| | |
|---|---|
| ***F04D 29/52*** | (2006.01) |
| ***F04D 29/42*** | (2006.01) |
| ***F04D 29/56*** | (2006.01) |
| ***F04D 29/64*** | (2006.01) |
| ***F04D 27/00*** | (2006.01) |
| ***F04D 29/32*** | (2006.01) |
| ***F04D 25/08*** | (2006.01) |

(Continued)

(52) U.S. Cl.

CPC ..... *F04D 29/522* (2013.01); *F04D 27/002* (2013.01); *F04D 29/329* (2013.01); *F04D 29/4226* (2013.01); *F04D 29/563* (2013.01); *F04D 29/646* (2013.01); *F04D 19/002* (2013.01); *F04D 25/08* (2013.01); *F04D 29/626* (2013.01)

(58) Field of Classification Search

CPC ..... F04D 19/002; F04D 25/08; F04D 27/002; F04D 29/4226; F04D 29/441; F04D 29/444; F04D 29/464; F04D 29/522; F04D 29/526; F04D 29/54–547; F04D 29/563; F04D 29/646; F04D 29/329

USPC ..... 415/160, 162, 189, 193–195, 208.4, 415/209.1–209.4, 214.1, 912; 417/423.1, 417/423.14, 423.15

See application file for complete search history.

(56) References Cited

U.S. PATENT DOCUMENTS 2,397,169 A * 3/1946 Troller ..... F04D 19/002 417/423.14

2,427,032 A * 9/1947 Troller ..... F04D 19/002 417/371

(Continued)

*Primary Examiner* — Alexander B Comley

(74) *Attorney, Agent, or Firm* — Stetina Brunda Garred and Brucker

(57) ABSTRACT

A modular adaptive performance fan may be provided for use in ventilation and cooling application. The modular adaptive performance fan may include an outer shroud, an inlet shroud, an inner hub, an impeller, a plurality of stator vane inserts, a diffuser cone, and a drive system. The modular adaptive performance fan may be configured to provide different performance and noise values desirable for different applications. Different characteristic performance curves with different BEP may be obtained by changing the geometry of the fan through the use of modular components.

10 Claims, 10 Drawing Sheets

(51) Int. Cl.
*F04D 29/62* (2006.01)
*F04D 19/00* (2006.01)

(56) References Cited

U.S. PATENT DOCUMENTS 2,444,966 A * 7/1948 Troller ..... F04D 19/002 417/423.14
2,488,945 A * 11/1949 Troller ..... F04D 19/002 417/423.14
2,552,118 A * 5/1951 Sawyer ..... F04D 19/002 138/37
2,731,193 A * 1/1956 Lall ..... F04D 29/646 417/423.15
2,781,165 A * 2/1957 Troller ..... F04D 29/646 417/423.15
2,866,594 A * 12/1958 Quick ..... F04D 17/165 417/423.1
2,956,731 A * 10/1960 Bayuk ..... F04D 19/002 417/423.14
3,089,637 A * 5/1963 Bell ..... F04D 19/002 417/368
3,346,174 A * 10/1967 Lievens ..... F04D 29/526 415/119
3,543,368 A * 12/1970 Marlow ..... F04D 29/445 29/889
3,561,883 A * 2/1971 Berry ..... F04D 29/36 415/131
3,664,001 A * 5/1972 Pilarczyk ..... F04D 29/4206 29/888.021
3,935,625 A * 2/1976 Saterdal ..... F04D 29/362 29/889.3
3,976,393 A * 8/1976 Larson ..... F04D 29/646 415/119
4,014,627 A * 3/1977 Heurteux ..... F01D 9/042 415/189
4,166,310 A * 9/1979 Rothe ..... B63H 11/08 29/404
4,336,749 A * 6/1982 Barnhart ..... F24F 13/20 248/58
4,669,164 A * 6/1987 Phelps ..... B23P 13/04 29/412
4,692,091 A * 9/1987 Ritenour ..... F04D 29/526 415/119
4,775,294 A * 10/1988 LaPorte ..... F04D 29/444 415/182.1
4,871,294 A * 10/1989 Ivanov ..... F01D 11/08 415/58.7
4,902,199 A * 2/1990 McDonald ..... F04D 25/16 415/143
5,494,404 A * 2/1996 Furseth ..... F01D 9/042 415/209.3
6,543,995 B1 * 4/2003 Honda ..... F01D 9/041 415/189
6,979,169 B2 * 12/2005 Penlesky ..... F04D 29/4226 415/1
7,025,576 B2 * 4/2006 Chaffee ..... A47C 27/082 417/366
8,282,348 B2 * 10/2012 Carl, Jr. ..... F04D 25/068 415/209.4
8,714,921 B2 * 5/2014 Tembreull ..... F04D 29/542 415/208.1
8,932,013 B2 * 1/2015 Khalitov ..... F04D 29/544 415/211.2
8,967,949 B2 * 3/2015 Gamissans Bou .... F04D 29/526 415/119
10,208,769 B2 * 2/2019 Cao ..... F04D 29/646
2008/0073983 A1 * 3/2008 Krajcir ..... H02K 5/24 310/51
2012/0128494 A1 * 5/2012 Pelley ..... F04D 29/64 416/151
2018/0142692 A1 * 5/2018 Kobayashi ..... F04D 27/002
2019/0211843 A1 * 7/2019 Dygert ..... F24F 13/20

* cited by examiner

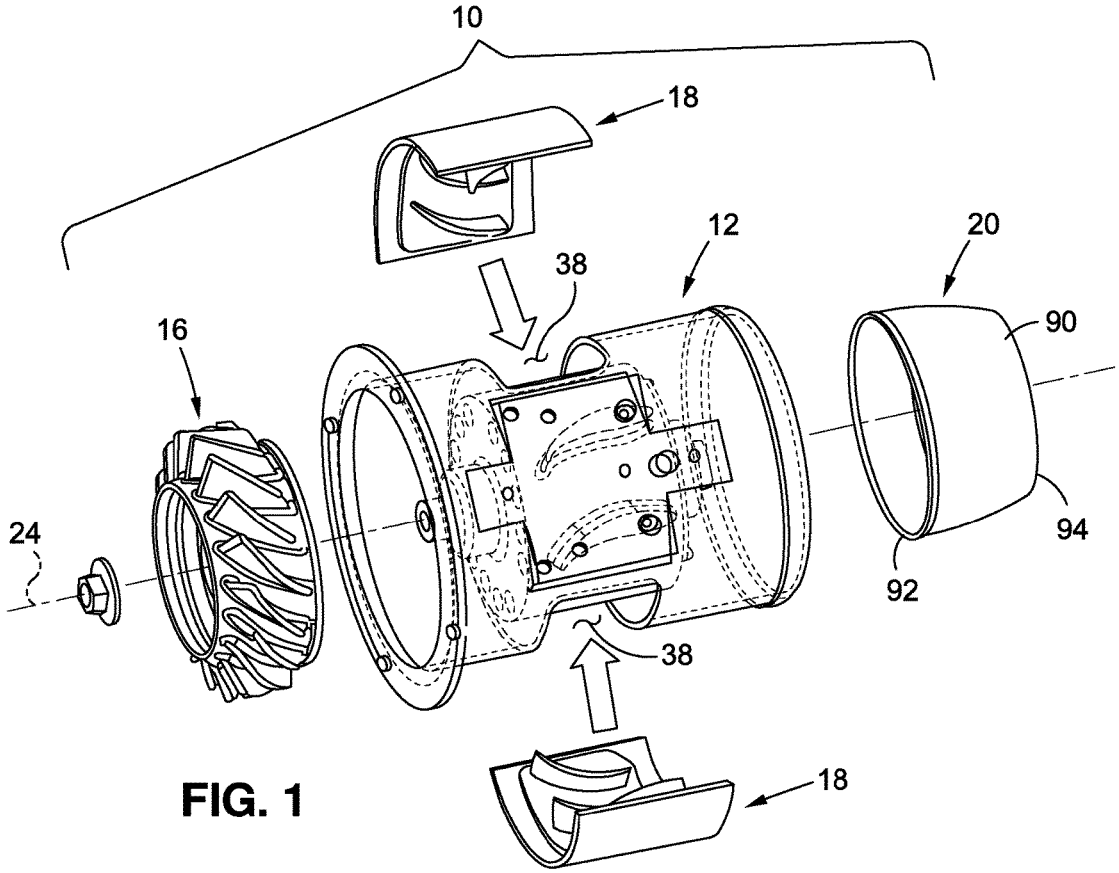
FIG. 1
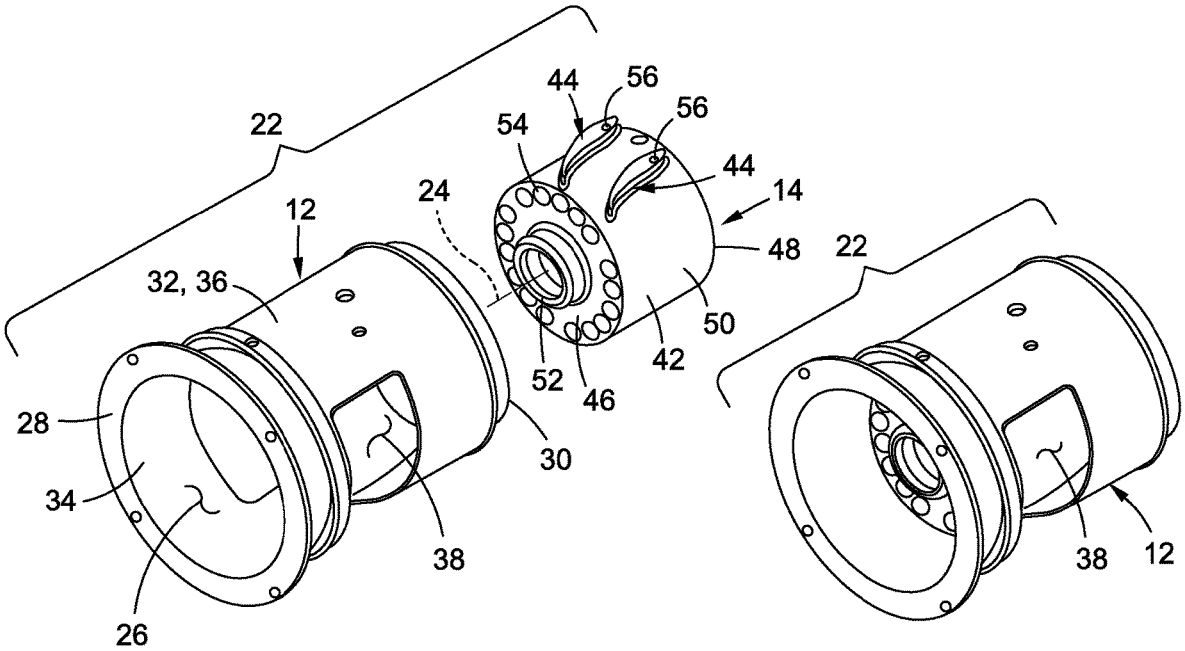
FIG. 2
FIG. 3

Rising Hub

| Parameter | Estimated |
|---|---|
| Air inlet density [lb/ft$^3$] | 0.075 |
| Shaft speed [rpm] | 17,000 |
| Air volumetric flow rate range [cfm] | 250-376 |
| Fan maximum total pressure | 14.8 inwg @ 260CFM |
| Maximum Efficiency [%] | 70 |

FIG. 12A

Axial

| Parameter | Estimated |
|---|---|
| Air inlet density [lb/ft$^3$] | 0.075 |
| Shaft speed [rpm] | 17,000 |
| Air volumetric flow rate range [cfm] | 350-485 |
| Fan maximum total pressure | 15.6 inwg @ 350CFM |
| Maximum Efficiency [%] | 76 |

FIG. 12B

| | | | |
|---|---|---|---|
| Configuration 1 | Impeller 1 | Stator Vane Insert 1 | Diffuser Cone 1 |
| Configuration 2 | Impeller 1 | Stator Vane Insert 1 | Diffuser Cone 2 |
| Configuration 3 | Impeller 1 | Stator Vane Insert 2 | Diffuser Cone 1 |
| Configuration 4 | Impeller 1 | Stator Vane Insert 2 | Diffuser Cone 2 |
| Configuration 5 | Impeller 2 | Stator Vane Insert 1 | Diffuser Cone 1 |
| Configuration 6 | Impeller 2 | Stator Vane Insert 1 | Diffuser Cone 2 |
| Configuration 7 | Impeller 2 | Stator Vane Insert 2 | Diffuser Cone 1 |
| Configuration 8 | Impeller 2 | Stator Vane Insert 2 | Diffuser Cone 2 |

FIG. 13

APPARATUS AND RELATED METHOD TO VARY FAN PERFORMANCE BY WAY OF MODULAR INTERCHANGEABLE PARTS

CROSS-REFERENCE TO RELATED APPLICATIONS

This application claims the benefit of U.S. Provisional Application No. 62/676,182, filed May 24, 2018, the contents of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to ventilation and cooling fans, and more specifically, to a modular adaptive performance fan that may be selectively configured through the implementation of modular components to provide different performance and noise values.

2. Description of the Related Art

Large-scale equipment, such as military aircraft, tanks, or the like, may require ventilation or cooling during operation thereof, which may be achieved by including one or more fans on the equipment. A fan typically has a characteristic performance curve (pressure gain vs. flow) with its best efficiency point (BEP) at a single combination of pressure and flow; any other operating point would likely be less efficient. In this regard, a specific fan may be most efficient when operating to achieve a specific performance objective.

However, the performance requirements for different pieces of equipment may vary. For instance, a tank may have one performance requirement as to ventilation and cooling, while a jet aircraft may include a different performance requirement. As such, a fan having a first aerodynamic geometry may be preferred to achieve a first performance requirement for a fan installed on a tank, while a different fan having a second aerodynamic geometry may be preferred for a fan installed on a jet airplane. For conventional fans, changing the geometry may require a completely new housing along with dedicated aerodynamic parts. Such an endeavor may be time consuming and costly.

Accordingly, there is a need in the art for a fan that is adaptable and allows for selective variation in the geometry thereof to achieve desired performance characteristics. Various aspects of the present disclosure address this particular need, as will be discussed in more detail below.

BRIEF SUMMARY

In accordance with one embodiment of the present disclosure, there may be provided a fan and related method of use, wherein the performance characteristics of the fan may be varied through the use and implementation of one or more modular components. By swapping modular components with core components, the geometry of the fan may be changed, which may result in the desired performance characteristics.

According to one embodiment, there may be provided a modular adaptive performance fan for use in ventilation and cooling in military equipment, such as jet airplanes and tanks. The modular adaptive performance fan may include an outer shroud, an inlet shroud, an inner hub, an impeller, a plurality of stator vane inserts, a diffuser cone, and a drive system (e.g., electric motor, hydraulic, or shaft driven). The modular adaptive performance fan may be configured to provide different performance and noise values desirable for different applications. Different characteristic performance curves with different BEP (e.g., best efficiency point) may be obtained by changing the geometry of the fan.

The changing of the geometry of the fan may be done through only the swapping of interchangeable aerodynamics parts, which may include at least one of the impeller, the stator vanes, and the diffuser cone.

The modular stator inserts may be inserted into the outer shroud in any fashion.

One or more of the aerodynamic parts being modular and independent of the fan envelope may allow a new set of such aerodynamic part(s) to be developed and then tested by placement into the existing fan template. Fans generated using this method may have the BEP tuned specifically to the performance and noise requirements of the user. Furthermore, the tuning of the BEP to the user requirements may be faster and less costly than current techniques.

The modular adaptive performance fan may include a controller, which may allow for an increase in the range of attainable performance and noise requirements by additionally varying the speed.

The outer shroud may include windows cut into the diameter. The inner hub may include three structural struts that may be aerodynamically streamlined and attachable to the outer shroud. The stator vane inserts may include stator vanes integrally formed therein. The stator vane inserts may be attachable and removeable through the windows formed in the outer shroud. Swapping the impeller, the stator inserts, and/or the diffuser cone may allow for a completely different characteristic performance curve to be obtained.

According to one embodiment, there is provided a modular adaptive performance fan comprising a fan core including an outer shroud and an inner hub connectable to the outer shroud. The outer shroud includes an inner surface, an outer surface, and at least one opening extending between the inner surface and the outer surface. A first set of modular components includes a first impeller, a first stator vane insert, and a first diffuser cone. A second set of modular components includes a second impeller, a second stator vane insert, and a second diffuser cone. The first set of modular components are engageable with the fan core to produce a first fan geometry associated first performance characteristics, and the second set of modular components are engageable with the fan core to produce a second fan geometry associated with second performance characteristics.

The inner hub may be positionable within the outer shroud. The inner hub may include a main body and a plurality of vanes extending from the main body toward the outer shroud when the inner hub is positioned within the outer shroud. The inner hub may include a plurality of bores extending into respective ones of the plurality of vanes, and the outer shroud may include a plurality of holes formed therein, with the plurality of bores being alignable with the plurality of holes.

The first stator vane insert may include a first arcuate base and a plurality of first vanes extending from the first arcuate base and the second stator vane insert may include a second arcuate base and plurality of second vanes extending from the second arcuate base. The first vanes may be of a first configuration and the second vanes may be of a second configuration different from the first configuration.

The at least one opening in the outer shroud may include a pair of openings positioned in spaced relation to each other and centered along a common circumference. The first set of modular components may include a pair of first stator vane inserts at least partially insertable into respective ones of the pair of openings to produce the first fan geometry, and the second set of modular components may include a pair of second state vane inserts at least partially insertable into respective ones of the pair of openings to produce the second fan geometry. The modular adaptive performance fan may additionally include a clamping band having an adjustable diameter and positionable around the outer shroud to secure the pair of first stator vane inserts or the pair of second stator vane inserts to the outer shroud.

The first impeller may include a tapered outer wall defining a variable diameter and the second impeller may include a cylindrical outer wall defining a uniform diameter. The first impeller may include first vanes and the second impeller may include second vanes having a different configuration from the first vanes.

The first diffuser cone may be of a first configuration and the second diffuser cone may be of a second configuration different from the first diffuser cone. The first diffuser cone may include a first main body defining a generally uniform diameter between opposed ends thereof, and the second diffuser cone may include a second main body defining a first diameter adjacent a first end thereof and a second diameter adjacent a second end thereof, with the second diameter being different from the first diameter.

According to another embodiment, there is provided a fan core for use with modular interchangeable aerodynamics parts including a modular impeller, a pair of modular stator vane inserts, and a modular diffuser. The fan core includes an outer shroud having an inner surface, an outer surface, and a pair of openings extending between the inner surface and the outer surface and positioned in spaced relation to each other and centered along a common circumference. The fan core further includes an inner hub positionable within the outer shroud. The inner hub comprises a main body and a plurality of vanes extending from the main body toward the outer shroud when the inner hub is positioned within the outer shroud. The outer shroud is configured to receive the pair of modular stator vane inserts within respective ones of the pair of openings. The fan core is engageable with the modular impeller and the modular diffuser such that the inner hub residing between the modular impeller and the modular diffuser.

The plurality of vanes of the inner hub may include a first vane, a second vane, and a third vane. The first vane may be circumferentially spaced from the second vane and the third vane by 135-175 degrees. The second vane may be circumferentially spaced from the third vane by 10-90 degrees.

According to yet another embodiment, there is provided a modular adaptive performance fan comprising a fan core including an outer shroud and an inner hub connectable to the outer shroud. The outer shroud includes an inner surface, an outer surface, and at least one opening extending between the inner surface and the outer surface. The modular adaptive performance fan additionally includes a first set of modular aerodynamics components, and a second set of modular aerodynamics components. The first set of modular aerodynamics components are engageable with the fan core to produce a first fan geometry associated first performance characteristics, and the second set of modular aerodynamics components are engageable with the fan core to produce a second fan geometry associated with second performance characteristics.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which:

FIG. 1 is an exploded, perspective view of a modular performance fan according to one embodiment of the present disclosure;

FIG. 2 is an exploded, upper perspective view of a fan core used in the modular performance fan depicted in FIG. 1;

FIG. 3 is an assembled, upper perspective view of the fan core depicted in FIG. 2;

FIG. 12A is a performance chart for a rising hub impeller;

FIG. 12B is a performance chart for an axial hub impeller; and

FIG. 13 is a chart presenting different configurations of the modular performance fan.

Common reference numerals are used throughout the drawings and the detailed description to indicate the same elements.

DETAILED DESCRIPTION

Figure 4:
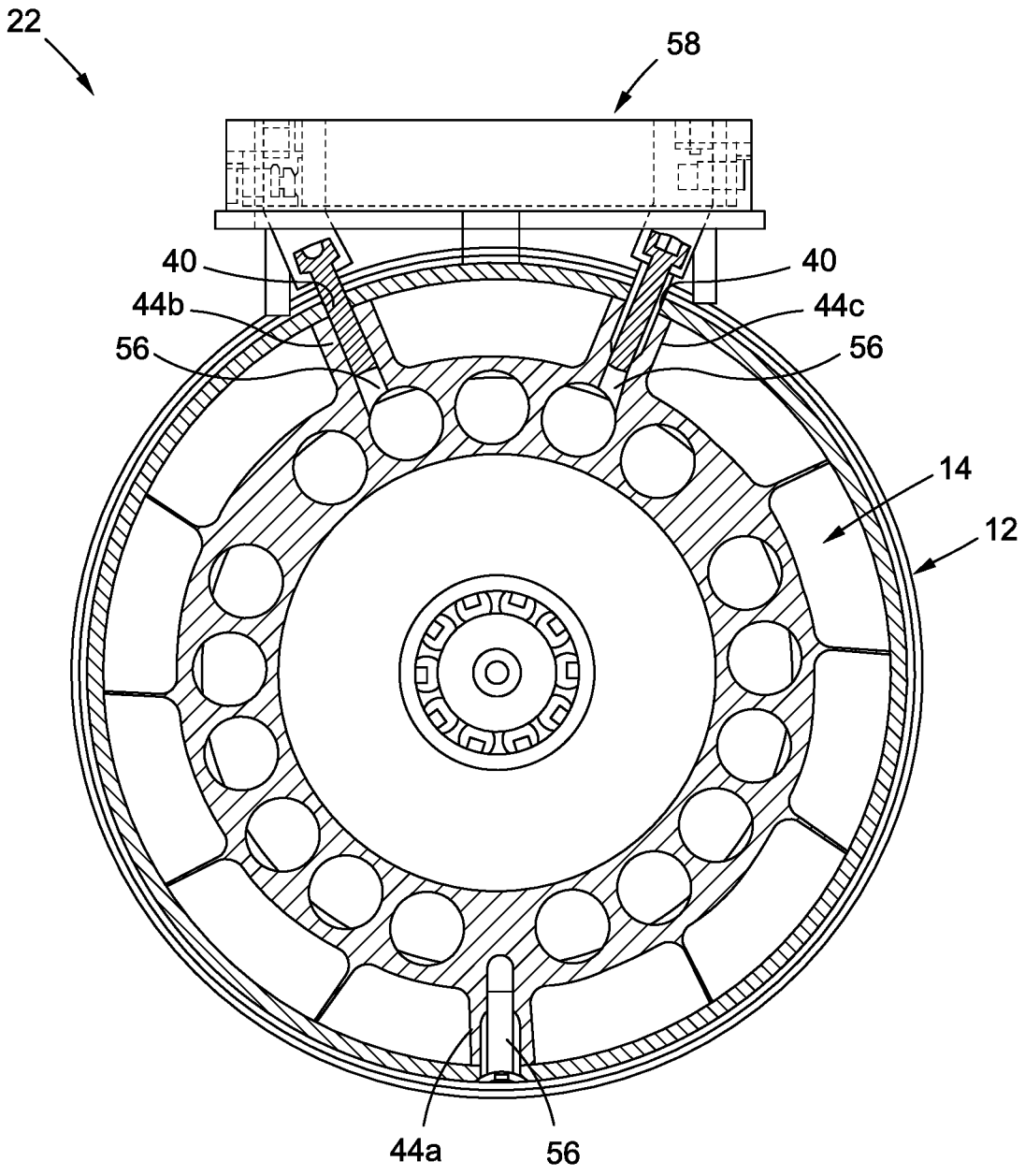
FIG. 4 is a front, cross sectional view of the fan core depicted in FIG. 3 with a motor controller mounted thereto.

The detailed description set forth below in connection with the appended drawings is intended as a description of certain embodiments of a modular adaptive performance fan and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Referring now to FIG. 1, there is depicted an embodiment of a modular adaptive performance fan 10 according to one embodiment of the present disclosure. The modular adaptive performance fan 10 may be configured to provide different performance and/or noise values depending on a desired use of the fan 10. For instance, it is contemplated that the fan 10 may be installed on different units, such as a jet airplane, a tank, or other vehicle, with desired performance characteristics differing from one unit to the next. Such desired performance characteristics may be achieved by changing the geometry of at least one component of the fan 10. The change in geometry may be implemented through modular components, which may be interchangeable with a common, base assembly. In this regard, one set of modular components may be tailored to achieve a first set of performance characteristics desirable for a first unit, while a second set of modular components may be tailored to achieve a second set of performance characteristics desirable for a second unit. Thus, by attaching the first set of components to the base assembly, the fan 10 may be customized for installation on the first unit (e.g., a fighter jet), and by attaching the second set of components to the base assembly, the fan 10 may be customized for installation on the second unit (e.g., a tank).

The fan 10 may generally include an outer shroud 12, an inlet shroud (not shown), an inner hub 14 (see FIG. 2), an impeller 16, a plurality of stator vane inserts 18, a diffuser cone 20, a drive system, and an associated controller assembly (if required). The outer shroud 12 and the inner hub 14 may collectively define a fan core 22, which may remain constant in different implementations of the fan 10, while one or more of the remaining components may be varied to achieve desired performance characteristics. In this regard, the impeller 16, the stator vane inserts 18, and the diffuser cone 20 may be modular in their construction to allow for desired interchangeability with the fan core 22.

Referring now to FIGS. 2-4, an exemplary fan core 22 is depicted. In particular, FIG. 2 is an upper perspective view depicting the inner hub 14 exploded from the outer shroud 12, while FIG. 3 is an upper perspective view, with the inner hub 14 assembled within the outer shroud 12. FIG. 4 is a front, cross sectional view showing engagement between the inner hub 14 and the outer shroud 12. The fan core 22 defines a central axis 24 (see FIG. 1), with the outer shroud 12 being disposed about the central axis 24 and having a central opening 26 extending along the central axis 24. The outer shroud 12 includes a first end face 28 and an opposing second end face 30, with the central opening 26 extending between the first and second end faces 28, 30. The outer shroud 12 further includes a sidewall 32 extending between the first and second end faces 28, 30, with the sidewall 32 including an inner surface 34 and an outer surface 36. The first end face 28 may be configured to include a flange portion extending radially outward beyond the sidewall 32. A circumferential groove may also be formed in the sidewall 32, adjacent the first end face 28.

The outer shroud 12 may be specifically sized and structured to facilitate engagement with the inner hub 14 as well as the stator vane inserts 18. To that end, the outer shroud 12 may include a plurality of openings 38 formed in the sidewall 32 to accommodate the respective ones of the stator vane inserts 18. The openings 38 may be centered along a common circumference of the sidewall 32, and spaced from each other along the common circumference. Furthermore, the outer shroud 12 may include a plurality of holes 40 (see FIG. 4) to facilitate engagement with the inner hub 14 via a mechanical fastener. The spacing of the holes 40 may correspond to the configuration of corresponding holes formed on the inner hub 14, as will be described in more detail below.

The inner hub 14 includes a main body 42 and a plurality of vanes 44 extending outward from the main body 42. The main body 42 may include a first face 46, an opposing second face 48, and a sidewall 50 extending between the first face 46 and the second face 48. A boss 52 may protrude outwardly from the first face 46 to facilitate engagement with the impeller 16, as will be described in more detail below. The main body 42, as shown, also includes a plurality of bores 54 formed in the first face 46.

The plurality of vanes 44 extend radially outward from the main body 42. Each vane 44 may be aerodynamically optimized to work with all possible configurations of the fan 12. In the exemplary embodiment, each vane 44 includes a first end positioned adjacent the first face 46 of the main body 42, and a second end positioned adjacent the second face 48 of the main body 42. Each vane 44 additionally includes a first sidewall and a second sidewall, with the first and second sidewalls converging at the first and second ends, with the distance between the first and second sidewalls defining a thickness of the vane 44. The vane 44 may be configured such that the thickness varies from the first end to the second end. In the exemplary embodiment, the maximum thickness is at a middle portion of the vane 44, while the ends define smaller thicknesses. The first and second sidewalls may include rounded or arcuate segments to achieve desired aerodynamic performance. In the exemplary embodiment, the inner hub 14 includes three vanes 44, namely, a first vane 44*a*, a second vane 44*b*, and a third vane 44*c*. From the perspective shown in FIG. 4, the first vane 44*a* extends from the main body 42 along a first axis, and the second and third vanes 44*b*, 44*c* extend from the main body along second and third axes, respectively, on opposite sides of the first axis. The second and third vanes 44*b*, 44*c* may be spaced 135-175 degrees from the first vane 44*a*, and anywhere from 10-90 degrees from each other.

Each vane 44 may include a bore 56 formed therein, which may be aligned with a corresponding hole 40 formed on the sidewall 32 of the outer shroud 12. A screw, bolt, or other mechanical fastener may be advanced through the aligned bore 56 and hole 40 to facilitate engagement between the inner hub 14 and the outer shroud 12. In this regard, when the inner hub 14 is coupled to the outer shroud 12, each vane 44 may extend from the main body 42 toward the inner surface 34 of the sidewall 32 of the outer shroud 12. The distance which each vane 44 extends from the main body 42 may be substantially equal to the size of an annular gap extending between the sidewall 32 of the outer shroud 12 and the main body 42.

Figure 5:
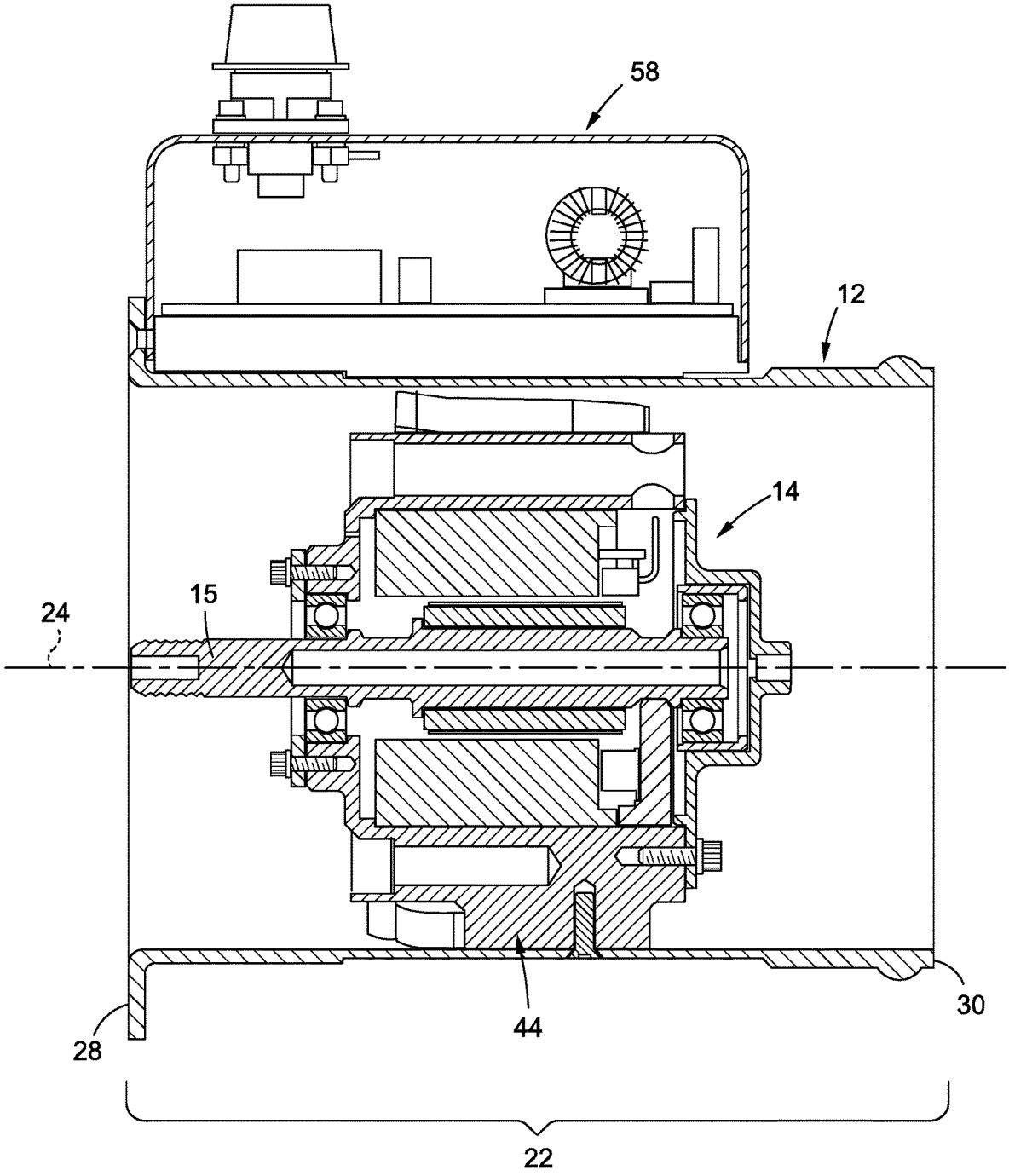
FIG. 5 is a side, cross sectional view of the fan core—motor controller assembly depicted in FIG. 4.

Referring now to FIG. 5, there is depicted a cross sectional, side view of the fan core 22, with the inner hub 14 connected to the outer shroud 12. The inner hub 14 is shown with a drive shaft 15, which may be coupled to the impeller 16 for imparting rotational drive to the impeller 16. A motor controller 58 is also coupled to the outer shroud 12, and is positioned on the outside of the outer shroud 12. The motor controller 58 may be in communication with the inner hub 14 to control the operative of a drive shaft coupled to the inner hub 14.

Figure 6A:
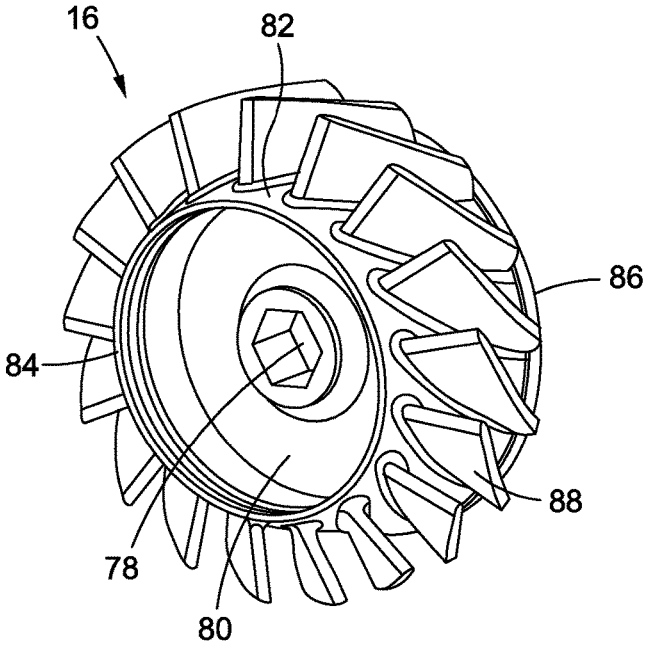
FIG. 6A is an upper perspective view of a replaceable impeller usable in the modular performance fan.
Figure 6B:
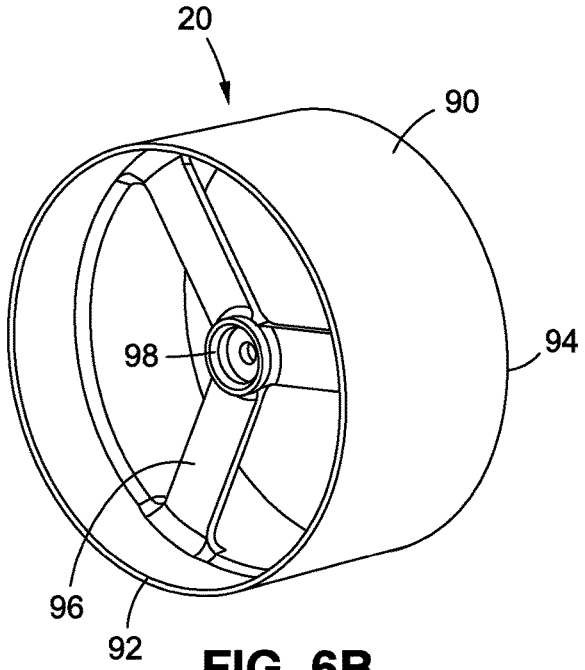
FIG. 6B is an upper perspective view of a diffuser usable in the modular performance fan.
Figure 6C:
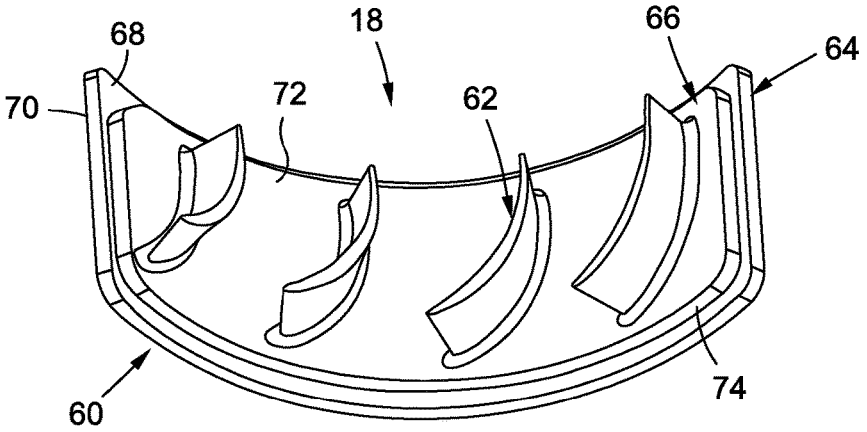
FIG. 6C is an upper perspective view of an impeller vane insert usable in the modular performance fan.

FIGS. 6A-6C depict replaceable aerodynamic components which may be detachably engageable with the fan core 22. In particular, an impeller 16 is depicted in FIG. 6A, a diffuser cone 20 is depicted in FIG. 6B, and a stator vane insert 18 is depicted in FIG. 6C.

Referring first to FIGS. 6C, as well as FIGS. 7 and 8, the stator vane inserts 18 will be described in more detail. Each stator vane insert 18 may generally include an arcuate base 60, and a plurality of vanes 62 extending from the arcuate base 60. The arcuate base 60 may have a stepped configuration, and include an outer base portion 64 and an inner base portion 66. The outer base portion 64 may include an inner surface 68 and an outer surface 70 and define an outer periphery. The inner base portion 66 may extend from the inner surface 68 and terminate at an exposed surface 72. The inner base portion 66 may additionally include an outer wall 74 spaced from the outer periphery of the outer base portion 64. The stator vanes 62 may be integrally formed with the arcuate base 60, and may extend from the exposed surface 72 of the inner base portion 66. Each stator vane 62 may include opposing first and second surfaces, which extend between opposing first and second ends. The first and second surfaces may be arcuate and may be specifically sized and structured to achieve desired aerodynamic characteristics. Each vane 62 may have a lean and sweep design for noise reduction.

It is contemplated that the stator vane inserts 18 may be modular, and thus, different stator vane inserts 18 may have different structural characteristics to modify the overall geometry of the fan so as to contribute to desired aerodynamic performance characteristics. For instance, the degree of curvature of the vanes 62 may vary, the size of the vanes 62 may vary, or the number of vanes 62 may vary.

Figure 7:
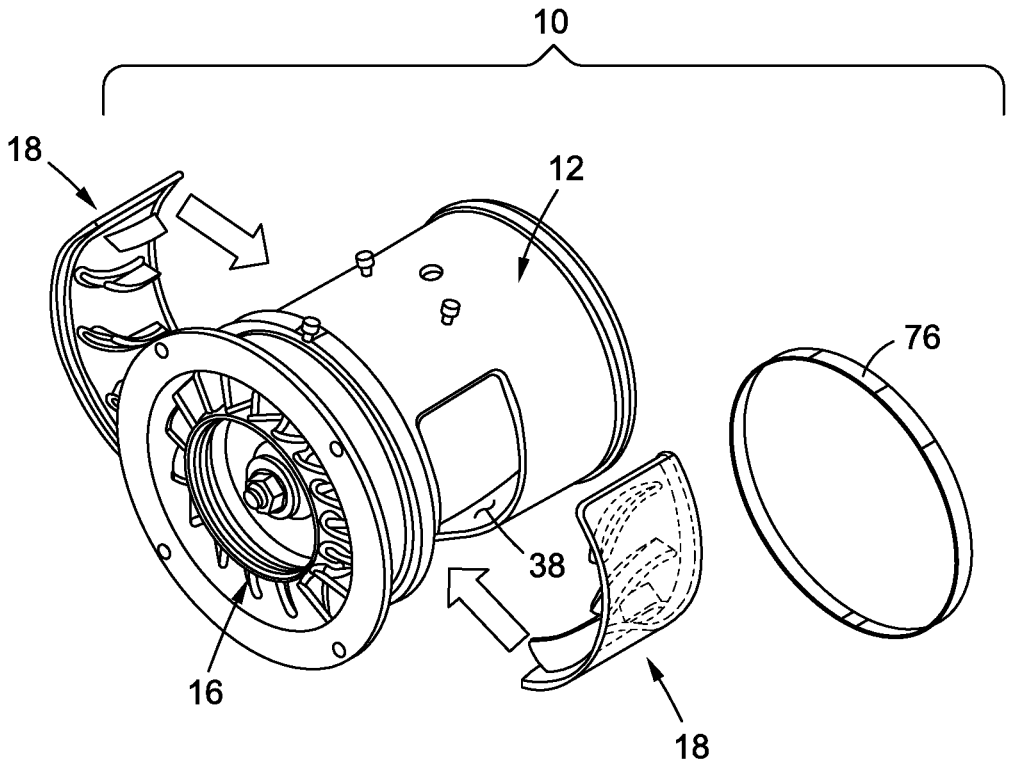
FIG. 7 is an upper perspective view of the modular performance fan with the stator vane inserts exploded from an outer shroud.
Figure 8:
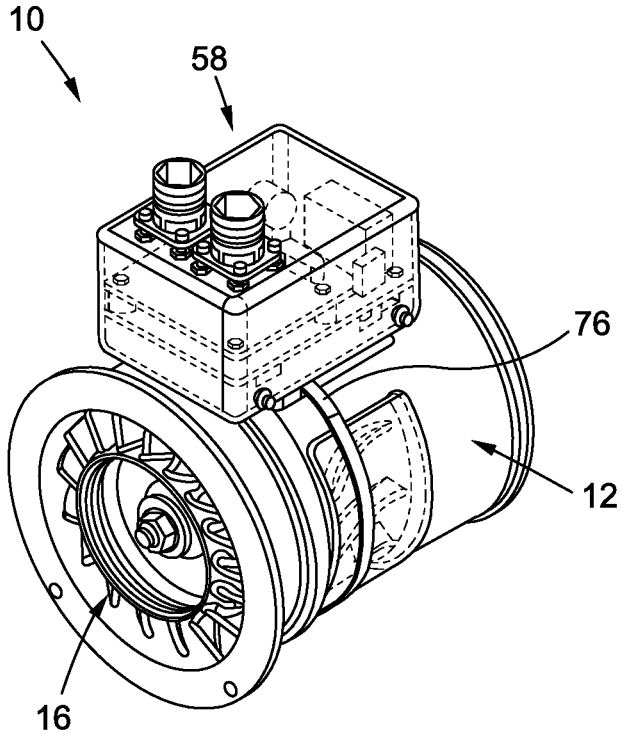
FIG. 8 is an upper perspective view of the modular performance fan with the stator vane inserts coupled to the outer shroud.

FIG. 7 is an upper perspective view of the stator vane inserts 18 exploded from the outer shroud 12, while FIG. 8 is an upper perspective view of the stator vane inserts 18 connected to the outer shroud 12. The stator vane inserts 18 may be sized and structured to correspond to the openings 38 formed in the outer shroud 12, such that the stator vane inserts 18 are at least partially received within respective ones of the openings 38. In one embodiment, the stator vane insert 18 is engaged with the outer shroud 12, such that the inner base portion 66 is received within a respective opening 38. The outer wall 74 of the inner base portion 66 may correspond in shape and configuration to the periphery of the opening 38, with the outer wall 74 possibly being slightly smaller than the periphery of the opening 38 to facilitate insertion. It is also contemplated that the outer wall 74 may be sized to create an interference fit with the outer shroud 12 when inner base portion 66 is received in the opening 38. The outer base portion 64 may extend over the outer shroud 12 and overlap with that portion of the outer shroud 12 immediately adjacent the opening 38. As can be seen in FIG. 8, a clamping band 76 may be used to secure the stator vane inserts 18 to the outer shroud 12. In this regard, the circumference of the clamping band may be reduced to retain the stator vane inserts 18 in place on the outer shroud 12. It is also contemplated that mechanical fasteners such as nails, screws, rivets, adhesives, or the like, may be used to join each stator vane insert 18 to the outer shroud 12. In one embodiment, the outer shroud 12 includes three openings 38, and thus, three stator vane inserts 18 may be inserted into respective ones of the three openings 38.

Figure 9A:
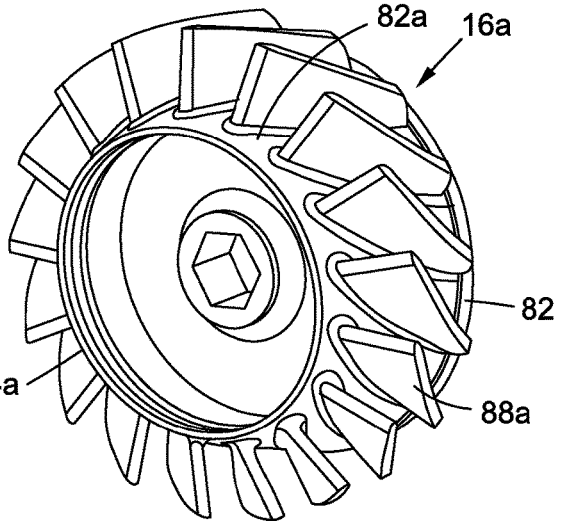
FIG. 9A is an upper perspective view of the rising hub impeller installed on the modular performance fan of FIG. 9.
Figure 9:
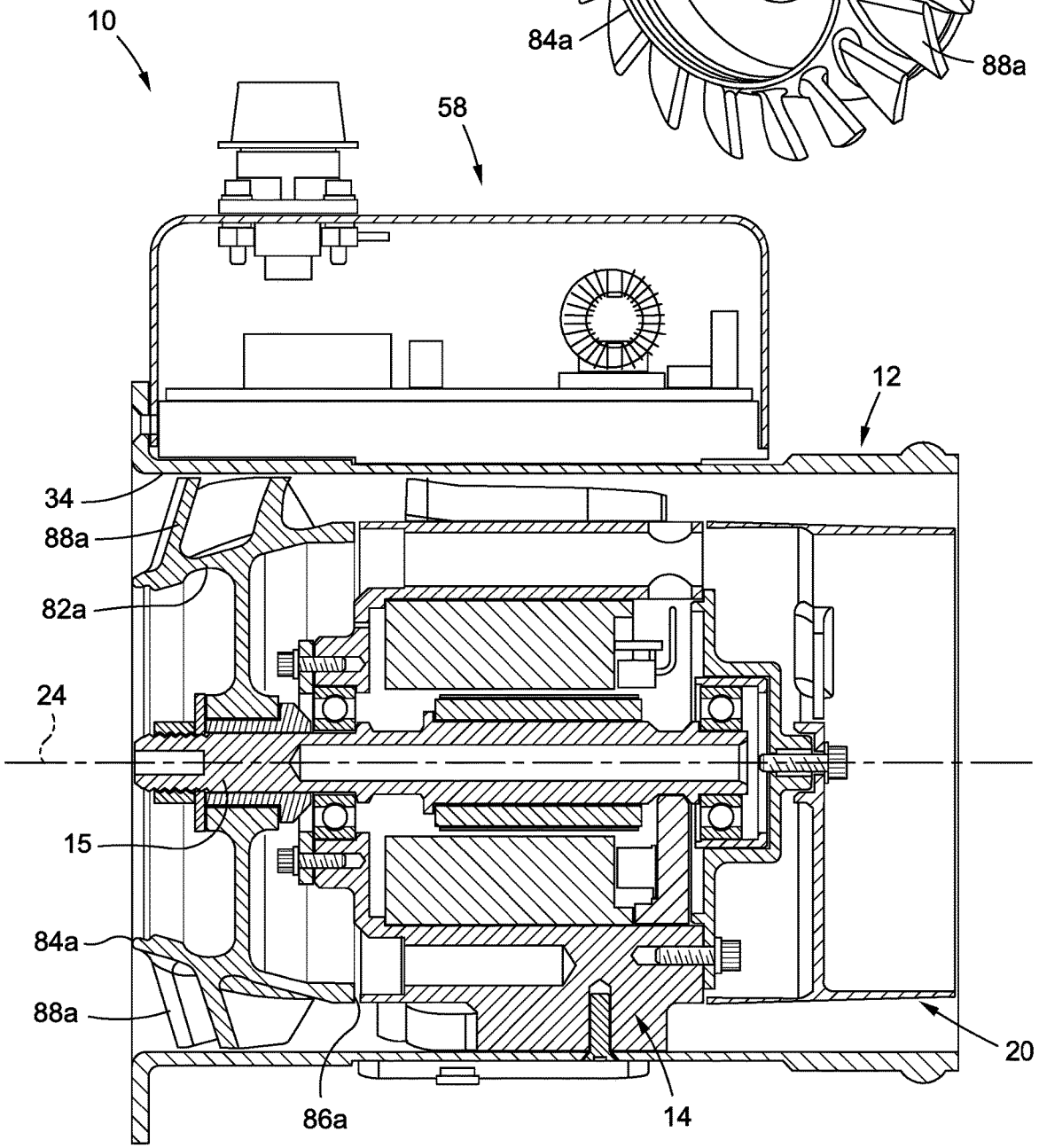
FIG. 9 is a side, cross sectional view of a modular performance fan having a rising hub impeller installed thereon.
Figure 10A:
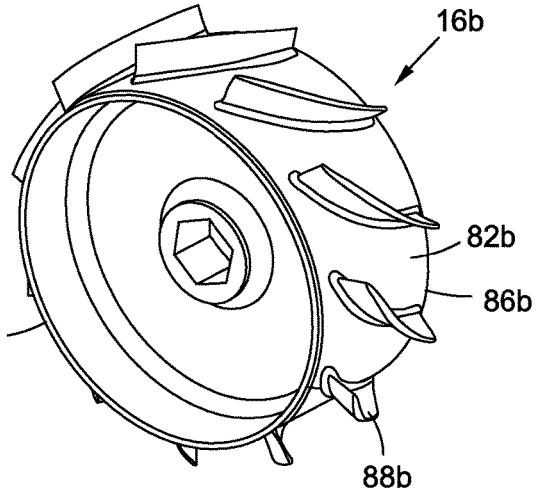
FIG. 10A is an upper perspective view of the axial hub impeller installed on the modular performance fan of FIG. 10.
Figure 10:
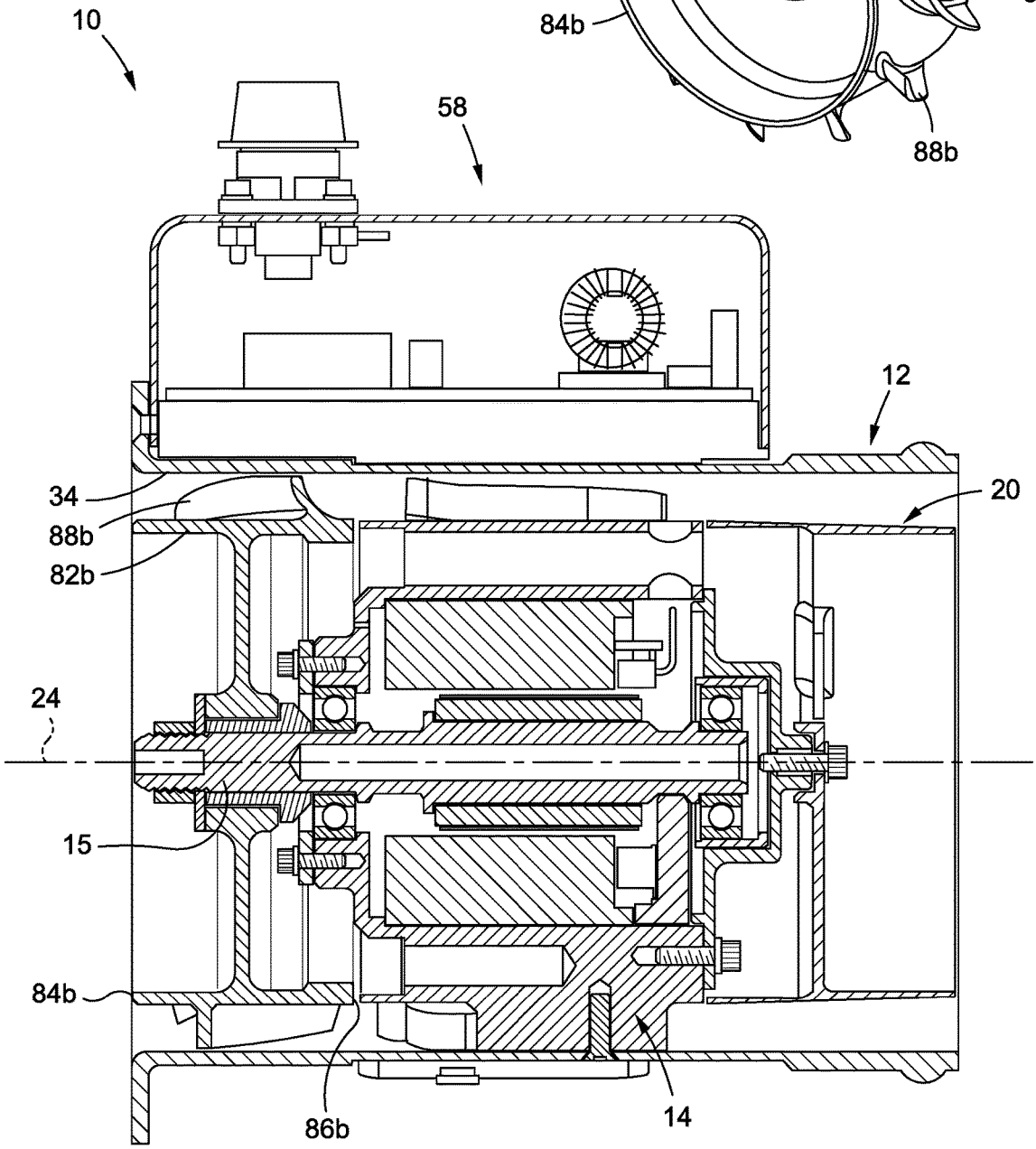
FIG. 10 is a side, cross sectional view of a modular performance fan having an axial hub impeller installed thereon.

Referring now to FIGS. 9-10, another modular component of the fan 10 may include the impeller 16. FIGS. 9 and 9A show a rising hub impeller 16*a* (e.g., a first impeller), while FIGS. 10 and 10A show an axial impeller 16*b*. The different impellers may be used with the fan core 22 to achieve different aerodynamic performance characteristics.

Before discussing the unique features of the rising hub impeller 16*a* and the axial impeller 16*b*, the common features of the impellers will be discussed. Along these lines, referring back to FIG. 6A, each impeller 16 may generally include a central opening 78, a radial wall 80 extending outwardly from the central opening 78, and an outer wall 82, with the radial wall 80 extending between the central opening 78 and the outer wall 82. The outer wall 82 includes a forward end 84 and a rearward end 86, and the radial wall 80 is positioned between the forward and rearward ends 84, 86. The impeller 16 includes a plurality of impeller vanes 88 extending outwardly from the outer wall. While these foregoing features may be shared between different impeller configurations, the following discussion will highlight differences between the rising hub impeller and the axial impeller.

Referring now specifically to FIGS. 9 and 9A, the rising hub impeller 16*a* includes an outer wall 82*a* that is of a tapered configuration. In this regard, a forward end 84*a* of the outer wall 82*a* is of a first diameter and the rearward end 86*a* of the outer wall 82*a* is of a second diameter greater than the first diameter. The outer wall 82*a* may be disposed about the central axis 24 when coupled to the fan core 22. As shown in FIG. 9, the outer wall 82*a* may define a frustoconical configuration, such that the radius from the central axis 24 at the forward end 84*a* is less than the radius from the central axis 24 at the rearward end 86*a*. The frustoconical configuration may create a tapered gap between the impeller 16*a* and the inner surface 64 of the outer shroud 12, i.e., the distance between the inner surface 34 of the outer shroud 12 and the outer wall 82*a* is greater at the forward end 84*a* than at the rearward end 86*a*.

Another unique feature of the rising hub impeller 16*a* may relate to the vanes 88*a*. As an initial matter, the number of vanes 88*a* may be unique, as well as the size and configuration of the vanes 88*a*. With regard to size, each vane 88*a* may define a vane height as the distance the vane 88*a* extends away from the outer surface 82*a* along an axis that is perpendicular to the central axis 24. The rising hub impeller 16*a* depicted in FIGS. 9 and 9A includes vanes 88*a* having a variable height. Along these lines, each vane 88*a* may include a forward end adjacent the forward end 84*a* of the outer wall 82*a* and a rearward end adjacent the rearward end 86*a* of the outer wall 82*a*. The height of the vane 88*a* at the forward end may be greater than the height of the vane 88*a* at the rearward end. The height may be tapered along the length of the vane 88*a*, with the height decreasing from the forward end toward the rearward end. The tapered height of the vane 88*a* may accommodate the tapered configuration of the gap between the outer wall and the outer shroud 12.

Referring now to FIGS. 10 and 10A, the axial impeller 16*b* includes an outer wall 82*b* that is of a cylindrical (i.e., non-tapered) configuration. In this regard, the forward end 84*b* of the outer wall 82*b* is of a diameter that is substantially equal to the diameter at the rearward end 86*b* of the outer wall 82*b*. As shown in FIG. 10, the radius from the central axis 24 at the forward end 84*b* is substantially equal to the radius from the central axis 24 at the rearward end 86*b*. The cylindrical configuration may create a generally uniform gap between the outer wall 82*b* and the inner surface 34 of the outer shroud 12.

Another unique feature of the axial impeller 16*b* may be in relation to the vanes 88*b*. The number of vanes 88*b* may be unique, as well as the size and configuration of the vanes 88*b*. As to the number of vanes 88*b*, the axial impeller 16*b* may include fewer vanes 88*b* than the rising hub impeller 16*a*. With regard to size, the axial impeller 16*b* depicted in FIGS. 10 and 10A includes vanes 88*b* having a generally uniform height. In other words, the height of the vane 88*b* at the forward end may be substantially equal to the height of the vane 88*b* at the rearward end. The uniform height of the vane 88*b* may correspond to the uniform configuration of the gap between the outer wall 82*b* and the outer shroud 12.

Figure 11:
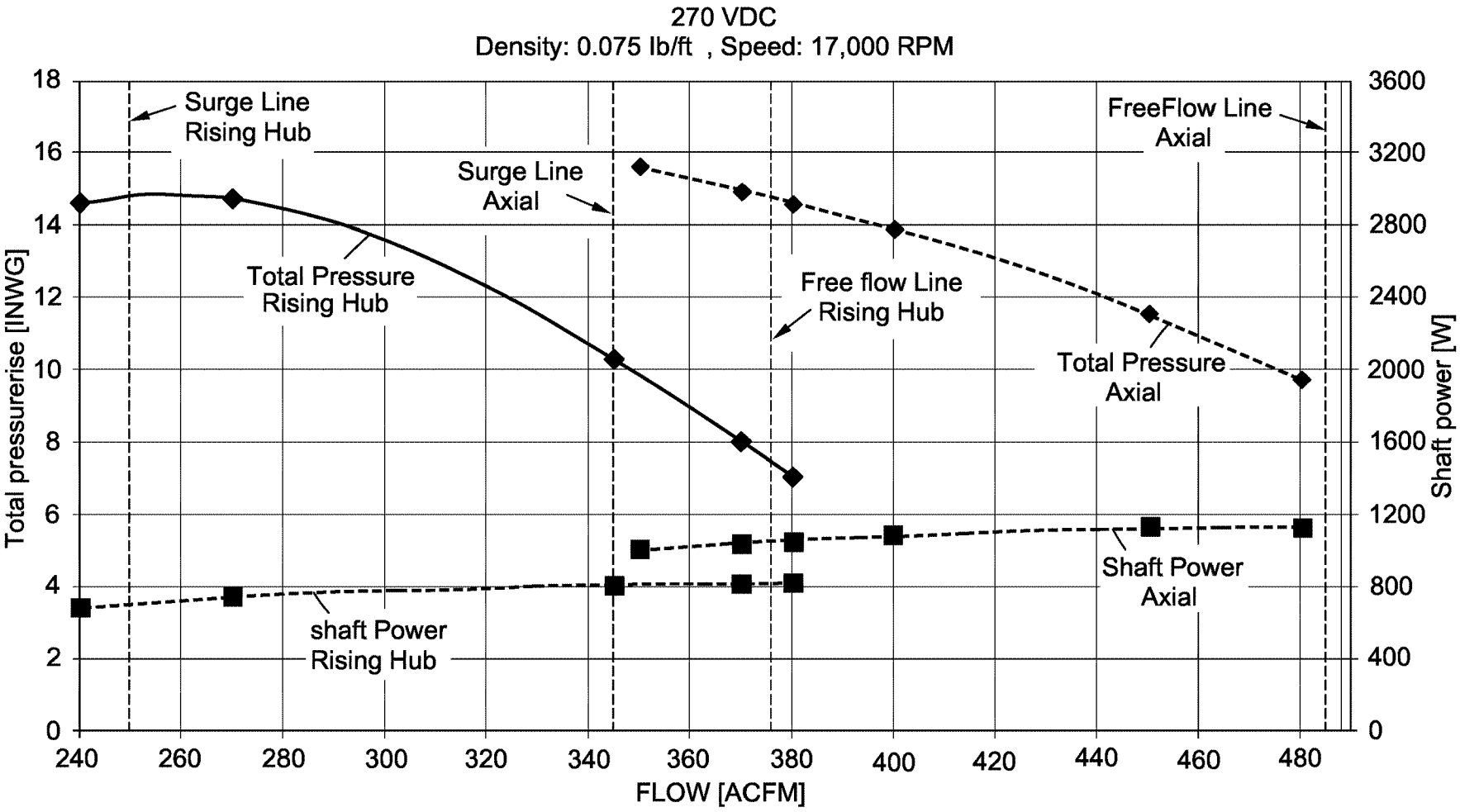
FIG. 11 is a graph depicting performance of both a rising hub impeller and an axial hub impeller.

Referring now to FIG. 11, there is depicted a performance chart showing operational data for both the rising hub impeller 16*a* as well as the axial hub impeller 16*b*. FIGS. 12A and 12B also include graphical data highlighting the different operational performance characteristics of both the rising hub impeller 16*a* and axial impeller 16*b*.

Referring back to FIGS. 1 and 6B, the diffuser cone 20 is another component of the fan 10 that may be modular. The diffuser cone 20 includes a main body 90 having a forward end 92 including a forward diameter and a rearward end 94 having a rearward diameter. A plurality of support ribs 96 may extend radially inward from the main body 90 to a central collar 98. The central collar 98 may include an opening for mounting the diffuser cone 20 to the inner hub 14.

One version of the diffuser cone 20 may include a generally uniform main body 90, wherein the forward diameter is substantially equal to the rearward diameter. Another version of the diffuser cone 20 may include a forward diameter that differs from the rearward diameter. For instance, the forward diameter may be larger than the rearward diameter. The different versions of the diffuser cones may be associated with different operational characteristics, and thus, may be interchanged with each other as desired based on the desired operational characteristics of the fan 10. In this regard, different versions of the diffuser cone 20 may include different geometries to derive different performance characteristics when implemented in the fan.

The modular components, namely, the impeller 16, the stator vane inserts 18, and the diffuser cone 20 may be interchanged with the fan core 22 to produce different performance characteristics of the modular adaptive performance fan 10. Different versions of the impeller 16, stator vane inserts 18 and diffuser cone 20 may include unique and distinctive geometries to produce the desired performance characteristics. FIG. 13 provides an outline of eight different configurations of the modular adaptive performance fan 10 when each of the impeller 16, stator vane inserts 18, and diffuser cone 20 are provided in two different variations. For instance, a user may have two options of impellers 16 (i.e., impeller 1 or impeller 2), two options of stator vane inserts 18 (i.e., stator vane insert 1 or stator vane insert 2), and two options of diffuser cones 20 (i.e., diffuser cone 1 or diffuser cone 2). With those options, the user may produce eight possible configurations of the fan 10, with each configuration being associated with distinctive performance characteristics. Obviously, by providing additional options of each modular component, additional configurations may be achieved. In this regard, the eight configurations provided in FIG. 13 are merely an example, and are not intended to limit the overall scope of the present disclosure.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A modular adaptive performance fan comprising: a fan core including an outer shroud and an inner hub connectable to the outer shroud, the outer shroud having an inner surface, an outer surface, and at least one opening extending between the inner surface and the outer surface; a first set of modular components including a first impeller, a first stator vane insert, and a first diffuser cone; and a second set of modular components including a second impeller, a second stator vane insert, and a second diffuser cone; the first set of modular components being engageable with the fan core to produce a first fan geometry associated with first performance characteristics; the second set of modular components being engageable with the fan core to produce a second fan geometry associated with second performance characteristics; wherein the inner hub is positionable within the outer shroud, the inner hub including a main body and a plurality of vanes extending from the main body toward the outer shroud when the inner hub is positioned within the outer shroud; and wherein the inner hub includes a plurality of bores extending into respective ones of the plurality of vanes, and the outer shroud includes a plurality of holes formed therein, the plurality of bores being aligned with the plurality of holes.

2. The modular adaptive performance fan recited in claim 1, wherein the first stator vane insert includes a first arcuate base and a plurality of first vanes extending from the first arcuate base and the second stator vane insert includes a second arcuate base and plurality of second vanes extending from the second arcuate base.

3. The modular adaptive performance fan recited in claim 2, wherein the first vanes are of a first configuration and the second vanes are of a second configuration different from the first configuration.

4. The modular adaptive performance fan recited in claim 1, wherein the at least one opening in the outer shroud includes a pair of openings positioned in spaced relation to each other and centered along a common circumference of the outer shroud.

5. The modular adaptive performance fan recited in claim 4, wherein the first set of modular components includes a pair of first stator vane inserts at least partially insertable into respective ones of the pair of openings to produce the first fan geometry, and the second set of modular components includes a pair of second stator vane inserts at least partially insertable into respective ones of the pair of openings to produce the second fan geometry.

6. The modular adaptive performance fan recited in claim 5, further comprising a clamping band having an adjustable diameter and positionable around the outer shroud to secure the pair of first stator vane inserts or the pair of second stator vane inserts to the outer shroud.

7. The modular adaptive performance fan recited in claim 1, wherein the first impeller includes a tapered outer wall defining a variable diameter and the second impeller includes a cylindrical outer wall defining a uniform diameter.

8. The modular adaptive performance fan recited in claim 1, wherein the first impeller includes first vanes and the second impeller includes second vanes having a different configuration from the first vanes.

9. The modular adaptive performance fan recited in claim 1, wherein the first diffuser cone is of a first configuration and the second diffuser cone is of a second configuration different from the first diffuser cone.

10. The modular adaptive performance fan recited in claim 9, wherein the first diffuser cone includes a first main body defining a generally uniform diameter between opposed ends thereof, and the second diffuser cone includes a second main body defining a first diameter adjacent a first end thereof and a second diameter adjacent a second end thereof, the second diameter being different from the first diameter.

* * * * *